United States Patent [19]

Almér et al.

[11] 4,076,205

[45] Feb. 28, 1978

[54] SUPPORT, INTENDED TO BE USED PRIMARILY AS A CHRISTMAS TREE STAND

[76] Inventors: Bengt Önnert Almér, Saltholmsgatan 55; Karl Gunnar Gidlöf, Forsvarsgatan 1, both of Vastra Frolunda, Sweden 42176

[21] Appl. No.: 747,011

[22] Filed: Dec. 2, 1976

[30] Foreign Application Priority Data

Dec. 9, 1975 Sweden ..... 7513841

[51] Int. Cl.[2] ..... A47G 33/12

[52] U.S. Cl. ..... 248/524; 269/229; 269/287; 279/51; 403/131

[58] Field of Search ..... 248/523, 524, 527; 269/229, 287; 279/51, 46, 17, 41; 403/131, 90, 122

[56] References Cited

U.S. PATENT DOCUMENTS

| | | | |
|---|---|---|---|
| 566,361 | 8/1896 | White | 403/131 |
| 848,850 | 4/1907 | Pissahl | 248/524 |
| 1,155,383 | 10/1915 | Tischer | 248/524 |
| 2,242,270 | 5/1941 | Sims | 248/524 |
| 2,879,977 | 3/1959 | Trought | 279/51 |
| 3,298,642 | 1/1967 | Taylor | 248/524 |
| 3,301,512 | 1/1967 | Nyberg | 248/524 |
| 3,334,888 | 8/1967 | Koranda et al. | 269/287 |
| 3,539,208 | 4/1969 | Gonsalves | 403/90 |
| 3,627,339 | 12/1971 | Burweger | 269/287 |
| 3,671,050 | 6/1972 | Andersson et al. | 279/51 |

*Primary Examiner*—Marion Parsons, Jr.
*Attorney, Agent, or Firm*—Newton, Hopkins & Ormsby

[57] ABSTRACT

A support to secure essentially rod-shaped objects, such as the end of e.g. a Christmas tree, comprising a base plate and a clamping member arranged to be secured about said rod-shaped object. The clamping member is compressible and has diametrically opposed apertures formed therein for insertion therethrough of said rod-shaped object. The body is arranged to be compressed about the end of said rod-shaped object through being forced partially down into a tube-shaped holding means provided on the base plate.

6 Claims, 4 Drawing Figures

SUPPORT, INTENDED TO BE USED PRIMARILY AS A CHRISTMAS TREE STAND

BACKGROUND OF THE INVENTION

The invention concerns a support intended to be used primarily as a Christmas tree stand, and comprising a base plate having a member thereon to be secured about the lower portion of an essentially rod-shaped object to be retained by the support, e.g. the trunk of a Christmas tree.

SUMMARY OF THE INVENTION

The invention is characterized in that the clamping member consists of a compressible body having diametrically opposed apertures formed therein, said body arranged to be compressed about the end of the object to be supported, e.g. the tree trunk, inserted through the apertures in the body, by means, lockable in various clamping positions, arranged to force said body partially down into a tube-shaped holder member formed in the base plate for its compression.

Preferably, the base plate is provided with a peripheral, upright wall, whereby a water container for the Christmas tree is formed.

In accordance with a preferred embodiment the lockable clamping means is in the form of lever which, when turned, forces a ring having a smaller diameter than the spherical body forming the clamping member, against this spherical body to compress the latter e.g. about the end of the tree trunk, said lever being lockable in various positions, e.g. by its engagement in any one of a plurality of notches formed in a sheet metal strip or similar means provided on said upright wall.

BRIEF DESCRIPTION OF THE DRAWINGS

The invention will be described in closer detail in the following with reference to the accompanying drawings, wherein.

DETAILED DESCRIPTION OF A PREFERRED EMBODIMENT

Figure 1:
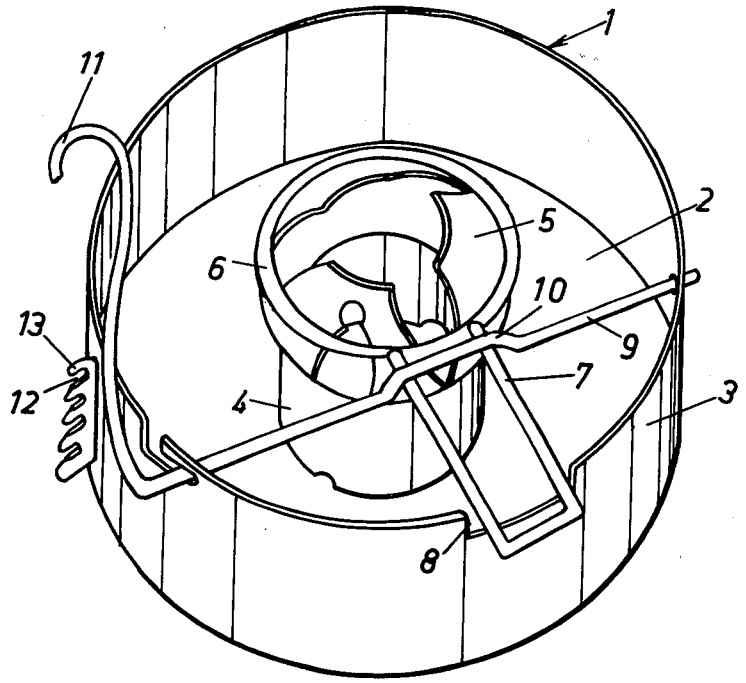
FIG. 1 is a perspective view of the support in accordance with the invention as seen obliquely from above, illustrating the embodiment thereof wherein it serves as a Christmas tree holder.

The Christmas tree stand illustrated in FIG. 1 comprises a base plate 2 along the edge of which extends an upright side wall 3. The base plate 2 together with the wall 3 form a container. In the center of the plate 2 is mounted a vertically extending pipe socket 4 or open top cup-like element. On the upper end of the pipe socket is supported a compressible member 5 the structure of which will be more closely described with reference to FIG. 4 and which is intended to serve to secure the lower end of the rod-shaped object to be supported by the stand, e.g. a tree trunk. The upper face of the member 5 supports a ring 6 the diameter of which is smaller than that of the spherical member 5, said ring 6 being provided with a handle 7 extending radially outwards to the side wall 3 in which its outer end is supported in a notch 8 formed in the wall. Although this notch by no means is necessary for the functioning of the device it is advantageous in that it stabilizes the position of the handle 7. Along a chord line of the circle formed by the side wall 3 extends a rod 9 having a bent portion 10 which abuts against the handle 7, and a lever portion 11 projecting outside the wall 3. Upon turning of the lever 11 into engagement with any one of a number of notches 12 formed in a sheet metal strip 13 secured on the outer face of the wall 3, the bent portion 10 will urge the ring 6 downwards over the member 5 and simultaneously press it partly down into the pipe socket 4, the member 5 thereby being compressed on account of its particular structure to be described in the following and thus securingly clamped about the rod end or tree trunk end. The compressible clamping member 5 is seated in the open mouth of cup-like member 4 and can be swiveled in any direction on the cup-like member to adjust the angle of a Christmas tree trunk prior to clamping in a fixed adjusted position.

Figure 2:
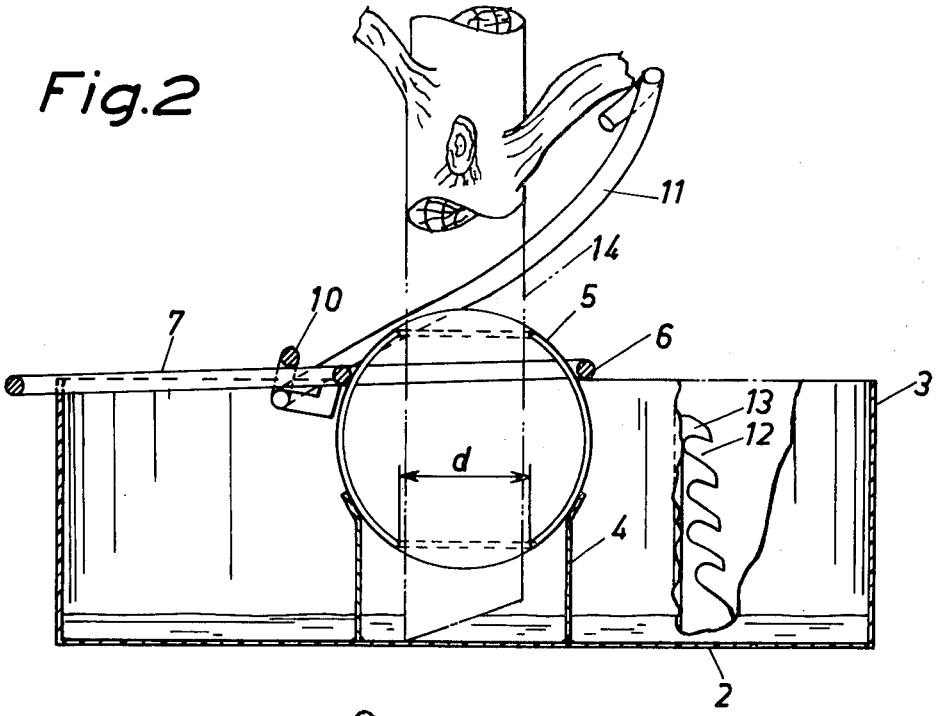
FIG. 2 is a side view indicating the tree trunk in dash and dot lines and showing the clamping member in its non-compressed position.
Figure 3:
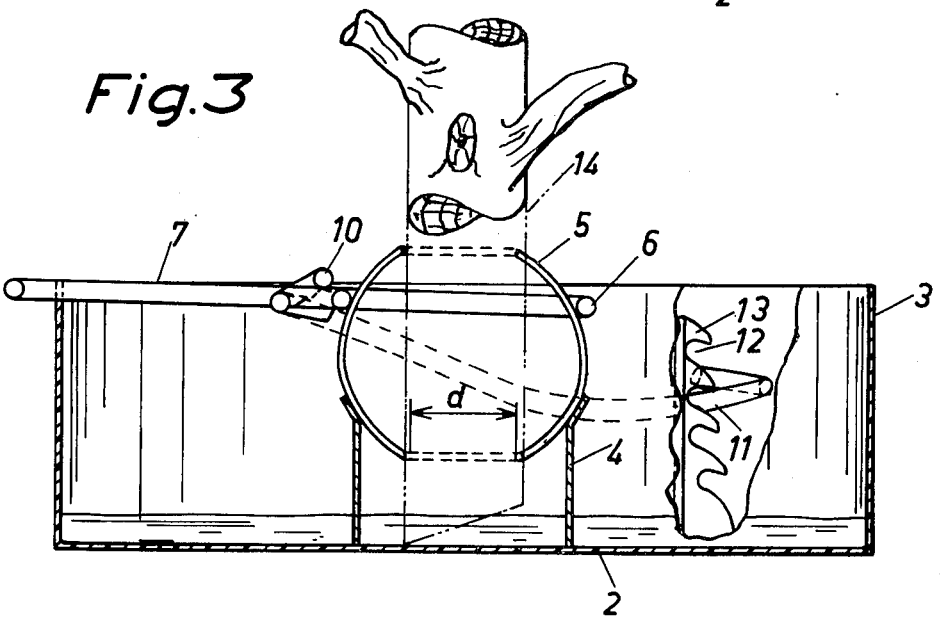
FIG. 3 is a view similar to FIG. 2 but illustrating the clamping member in its compressed, tree-securing position.

FIG. 2 is a lateral view of the stand in accordance with the invention, illustrating the position of the support when the latter is to be used as a Christmas tree stand and the end 14 of the tree trunk has been inserted through openings formed in the member 5 so as to abut against the base plate 2. With the tree end 14 positioned inside the clamping member 5 it is now easy to turn the tree into the desired position, i.e. in the case of a Christmas tree in a vertical position, whereafter the member 5 is turned into the position illustrated in FIGS. 1 and 2 and thus tightened about the tree end 14. The result is a reduction of the diameter $d$ of the aperture 16 (FIG. 4) through which the tree trunk end is inserted, such that this diameter, originally somewhat larger than that of the tree trunk, as illutrated in FIG. 2, is reduced to a size slightly smaller than the diameter of the tree trunk, as illustrated in FIG. 3.

Figure 4:
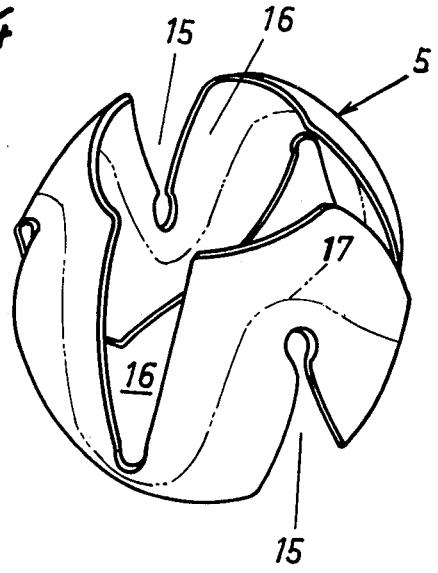
FIG. 4 is a detail of the support in accordance with the invention.

FIG. 4 illustrates the clamping member 5 in the shape of a spherical body in accordance with the embodiment shown herein. This body is made from an elastic material, preferably plastics, with indentations 15 formed therein, extending from diametrically opposed openings 16 provided to allow insertion of the end 14 of the tree trunk. As indicated in dash-and-dot lines 17, the body could be made from two narrow sections, which would increase its elasticity and all difficulties be eliminated that might arise in connection with insertion and removal of the tools used to manufacture the member. In effect, the clamping member 5 is a hollow spherically curved resilient shell having plural integrally connected circumferentially spaced mutually coacting clamping jaws at the top thereof, the jaws being segments of the spherical shell which has the diametrically extending through opening 16 to receive the tree trunk or stem or other rod-like member, such as a beach umbrella standard. The resilient clamping jaws on the spherical member are intervened by the slots 15.

The invention is not limited to the embodiment as described and illustrated but various modifications are possible within the scope of the appended claims. For instance, the clamping member need not be spherical but could have some other shape, e.g. pear-shape, the only requirement being that the shape allows the member, to be securely clamped about the end of the rod-like object to be secured, when exposed to pressure. Obviously, the clamping member should have a shape making it possible to correct the alignment of the object supported by it. When the support is used as a Christmas tree stand, the bowl formed by plate 2 and wall 3 serves as a water container but when other rods, such as e.g. road signs, are to be supported thereby, the stand may be stabilized by e.g. sand with which the container is filled. The support in accordance with the invention also lends itself to combined uses, i.e. both as a Christmas tree stand and as a sun shade support, depending on the seasons of the year. The wall 3 is not always necessary.

What we claim is:

1. A support for a Christmas tree or the like comprising a base member adapted to rest on a level supporting surface, an open top cup-like element secured to the base member and rising therefrom, a unitary hollow clamping shell which is rounded at least on its portion which is lowermost during use and being formed of resilient material, the rounded portion of the clamping shell resting on the open top of the cup-like element and being swiveled on such open top for universal adjustment, the clamping shell having a top-to-bottom through opening adapted to receive a Christmas tree trunk or the like, the clamping shell being circumferentially slotted to form plural circumferentially spaced clamping jaws whose top edges in the use position of the clamping shell are adapted to be forced into clamping engagement with a Christmas tree trunk or the like, and a lockable adjustable operating means for the clamping shell on said base member including a camming element having camming engagement with said jaws, movement of the camming element in a downward direction forcing the lower rounded portion of the clamping shell downwardly in the cup-like element to thereby force said clamping jaws into clamping engagement with a Christmas tree trunk or the like being supported.

2. An improved support according to claim 8, comprising an essentially vertical wall extending about the periphery of said base member.

3. A support for a Christmas tree or the like according to claim 1, wherein said clamping shell when in a relaxed state is spherically formed in its entirety and said open top cup-like element has a flared mouth engaging the spherical clamping shell approximately tangentially.

4. A support for a Christmas tree or the like according to claim 1, and said lockable adjustable operating means comprising a rod forming a rocker shaft on said base member and including a hand lever extension, said camming element comprising a ring element on the rocker shaft and movable therewith downwardly into closing relationship with said clamping jaws.

5. A support for a Christmas tree or the like according to claim 4, and a member on said base member having spaced locking notches to receive and lock said hand lever extension selectively in plural positions of use.

6. A support for a Christmas tree or the like according to claim 3, and said lockable adjustable operating means comprising a manually operated rockable means on the base member including said camming element, said camming element comprising a ring element engageable downwardly over the spherical faces of said clamping jaws.

* * * * *